US006509879B2

(12) United States Patent
Cassel

(10) Patent No.: US 6,509,879 B2
(45) **Date of Patent: *Jan. 21, 2003**

(54) ANTENNA FOR A RADIO COMMUNICATIONS APPARATUS

(75) Inventor: Erland Cassel, Djursholm (SE)

(73) Assignee: Moteco AB, Ruda (SE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/403,863

(22) PCT Filed: Apr. 27, 1998

(86) PCT No.: PCT/SE98/00764

§ 371 (c)(1),
(2), (4) Date: Oct. 28, 1999

(87) PCT Pub. No.: WO98/49742

PCT Pub. Date: Nov. 5, 1998

(65) Prior Publication Data

US 2002/0030627 A1 Mar. 14, 2002

(30) Foreign Application Priority Data

Apr. 30, 1997 (SE) ..... 9701646

(51) Int. Cl.[7] ..... H01Q 13/10
(52) U.S. Cl. ..... 343/767; 343/746; 343/700 MS
(58) Field of Search ..... 343/702, 700 MS, 343/767, 746, 895

(56) References Cited

U.S. PATENT DOCUMENTS

| | | | | |
|---|---|---|---|---|
| 3,702,481 A | * | 11/1972 | Koller et al. | 343/844 |
| 4,335,385 A | | 6/1982 | Hall | 343/700 MS |
| 4,398,199 A | | 8/1983 | Makimoto et al. | 343/700 MS |
| 4,443,802 A | | 4/1984 | Mayes | 343/729 |
| 5,541,610 A | * | 7/1996 | Imanishi et al. | 343/702 |
| 5,642,120 A | | 6/1997 | Fujisawa | 343/702 |
| 5,754,143 A | * | 5/1998 | Warnagiris et al. | 343/676 |

(List continued on next page.)

FOREIGN PATENT DOCUMENTS

| | | |
|---|---|---|
| AT | 396 532 B | 10/1993 |
| WO | WO 93/12559 | 6/1993 |
| WO | WO 98/49743 | 4/1998 |

OTHER PUBLICATIONS

EP 616734—English language claims—Aug. 16, 1995.
07227959, Sep. 5, 1995, Japan—Abstract Only.
07241305, Sep. 20, 1995, Japan—Abstract Only.
SE 9701646–3, Apr. 30, 1997, Sweden—Abstract Only.
PCT International Preliminary Examination Report.
PCT International Search Report.

*Primary Examiner*—Don Wong
*Assistant Examiner*—Tuyet T. Vo
(74) *Attorney, Agent, or Firm*—Smith, Gambrell & Russell LLP

(57) ABSTRACT

The disclosure relates to an antenna. To improve transmission and reception in a mobile telephone, it has what is termed a diversity antenna. The invention relates to an antenna suitable as a diversity antenna. The antenna has a plate of insulating material with a foil coating on both sides. In the foil there are provided two slots, one on each side. The slots have meander formations or windings in order that their electric length exceed their physical length. The one slot is 1-3 % longer than the other. At one closed end of the one slot, there are connections for a supply line. The foil coatings are in contact with one another through a plate which is soldered fast on the side of the carrier at right angles thereto. Laterally in relation to the longitudinal direction of the slots, there is an earth plane. The foil coatings extend out on this, and both sides are in galvanic communication with one another. In order to increase the electric length of the earth plane, slots are provided in the foil coatings.

47 Claims, 2 Drawing Sheets

U.S. PATENT DOCUMENTS 5,757,326 A 5/1998 Koyama et al. ..... 343/702
5,867,126 A * 2/1999 Kawahata et al. ..... 343/702
5,872,542 A 2/1999 Simons et al. ..... 343/700 MS
5,914,693 A * 6/1999 Takei et al. ..... 343/767
5,955,997 A * 9/1999 Ho et al. ..... 343/767
5,966,097 A * 10/1999 Fukasawa et al. ... 343/700 MS
6,005,524 A * 12/1999 Hayes et al. ..... 343/702
6,040,803 A * 3/2000 Spall ..... 343/700 MS

* cited by examiner

ANTENNA FOR A RADIO COMMUNICATIONS APPARATUS

TECHNICAL FIELD

The present invention relates to an antenna for a radio communications apparatus operating in the frequency range of 800 MHz–3 GHz and including a slot provided in a metallic conductor.

BACKGROUND ART

In the employment of mobile radio communications apparatuses, in daily parlance mobile telephones in an urban environment, problems are often encountered in transmission and receiving. The reason for this is that, in such an environment, there are often dead zones which cannot be reached in communication with a certain cell in the system.

In order to remedy this problem, use is often made of duplicated antennae in mobile telephones, these antennae having different directive effect, polarisation and/or appearance on the antenna lobe. Such a second antenna is often entitled a diversity antenna.

PROBLEM STRUCTURE

The present invention has for its object to design the antenna intimated by way of introduction such that this will be suitable for use as a diversity antenna. Thus, the present invention has for its object to design the antenna in such a way that it will have a directive effect, good efficiency and, above all, extremely small dimensions so that it may be incorporated entirely into an apparatus casing. Finally, the present invention has for its object to realise an antenna which is of wide band operation.

SOLUTION

The objects forming the basis of the present invention will be attained if the antenna intimated by way of introduction is characterized in that the slot has windings or meander formations disposed in one plane.

As a result of this feature, advantages will be afforded such as directive effect and extremely small integration dimensions.

Suitably, the antenna is also characterized in that it includes two slots disposed in substantially parallel planes, both having windings or meander formations and in which the one slot is of slightly greater length than the other.

As a consequence of these characterizing features, advantages will be afforded such as increased sensitivity and wide band capability despite the fact that the physical integration dimensions are hardly affected.

Further advantages will be attained according to the present invention is the antenna is also given one or more of the characterizing features as set forth in appended claims 4 to 14.

BRIEF DESCRIPTION OF THE ACCOMPANYING DRAWINGS

The present invention will now be described in greater detail hereinbelow, with reference to the accompanying Drawings. In the accompanying Drawings.

DESCRIPTION OF PREFERRED EMBODIMENT

Figure 1:
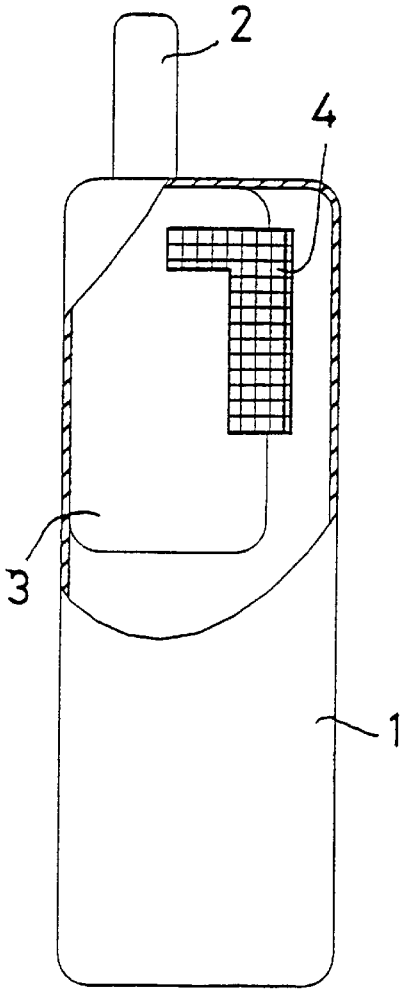
FIG. 1 is a rear view of a cut open mobile telephone which is provided with a diversity antenna according to the invention.

In FIG. 1, reference numeral 1 relates to the outer hood or casing of a mobile telephone which has an outer antenna 2. The mobile telephone according to FIG. 1 is seen from the rear side, i.e. that side which faces away from the key cluster etc. It will be further apparent from the figure that, interiorly in the mobile telephone, there is a screen can 3 which houses the electronics included in the telephone. Furthermore, there is mounted in connection with the screen can a diversity antenna 4. The antenna 4 has only been shown in respect of its outer contours and physical location.

The antenna 4 is a novel diversity antenna and includes a metallic conductor 10 with a radiating slot.

Figure 2:
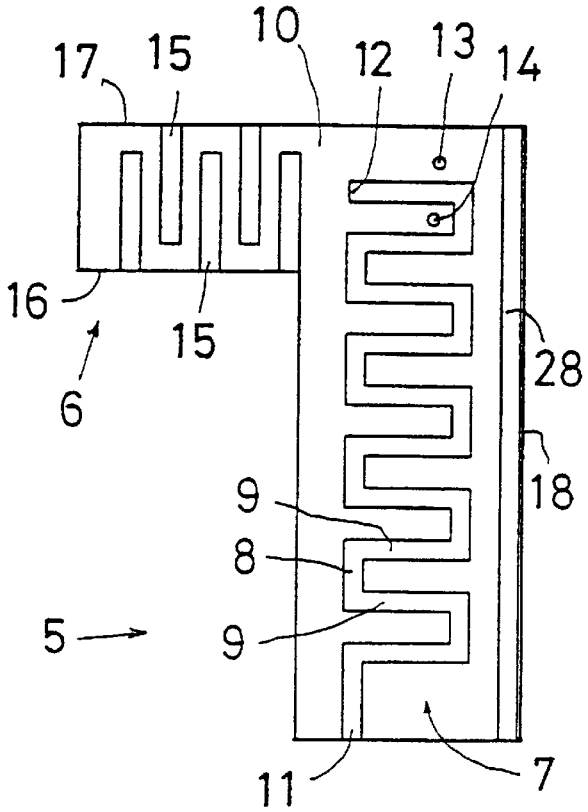
FIG. 2 shows the antenna of FIG. 1 on a larger scale.

In the view illustrated in FIG. 2, the antenna 4 is in the form of an inverted L which is composed of a larger rectangular part 5 and a smaller rectangular part 6. The larger rectangular part 5 contains the antenna proper, while the smaller rectangular part 6 contains an earth plane for the antenna. The conductor 10 around the slot also functions as an earth plane.

The antenna according to FIG. 2 has, on the side facing towards the observer, a metal foil 10 in which grooves or slots are provided. In the larger part 5, the antenna 4 has a continuous slot 7 which is the radiating portion of the antenna. In order to reduce the space requirements, the slot 7 is designed with windings or meander formations. On the Drawing, shorter slot portions 8 are shown which are substantially at right angles in relation to the longer slot portions 9. The windings or meander formations lie in a common plane which corresponds to the plane of extent of the foil-shaped metallic conductor 10 in which the slot 7 is accommodated. Given that the slot has windings or meander formations, it will have an electric length which is considerably greater than its physical length. If, in addition, the slot is filled with plastic, the electric length will be even greater in relation to the physical length. An antenna of this type also has a certain directive effect.

In FIG. 2, the antenna is designed as a quarter wave antenna where the one end 11 of the slot 7 is open. The opposite end 12 of the slot 7 is closed. In the proximity of the closed end 12, there are provided connections 13, 14 for supply to the antenna.

If the antenna 4 is to be designed as a half wave antenna, the slot 7 is made correspondingly longer and its end 11 is to be closed.

The foil-shaped conductor 10 extends out on the smaller rectangular part 6 of the antenna and there forms an earth plane. In order to increase the electrical size of the earth plane, this is also provided with alternatingly disposed slots 15 which have their one end open towards opposing edges 16 and 17 of the smaller rectangular part 6.

Along the right-hand edge of the larger rectangular part 5 in FIG. 2, there is disposed an elongate plate 18 which, via a solder 19, is connected to the metallic conductor 10 on the front side of the antenna in FIG. 2. As a result, the plate 18 is in galvanic communication with the foil-shaped conductor throughout the entire length of the plate.

The plane of extent of the plate 18 is transversely directed, but also preferably at right angles, to the plane of extent of the foil-shaped conductor 10. This is clearly apparent from FIG. 3. Further, the plate 18 is, throughout its entire length, of greater width than the thickness of the carrier 20 of insulating, non-magnetic material which is employed for supporting the metallic conductor 10. The plate 18 also functions as an amplifier of the earth plane of the antenna.

Figure 3:
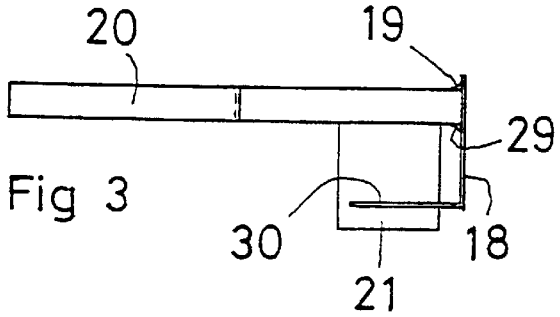
FIG. 3 is a view of the antenna of FIG. 2 seen from beneath in FIG. 2.

It is further apparent from FIG. 3 that there is disposed, on the rear side of the antenna 4 in FIG. 2, a terminal 21 for connecting a supply line. Solder pins in the terminal 21 extend through the carrier 20 and are visible on the front side of the antenna in FIG. 2 at the connections 13 and 14, but not however forming a galvanic communication with the foil-shaped conductor 10 on the front side of the antenna.

Figure 5:
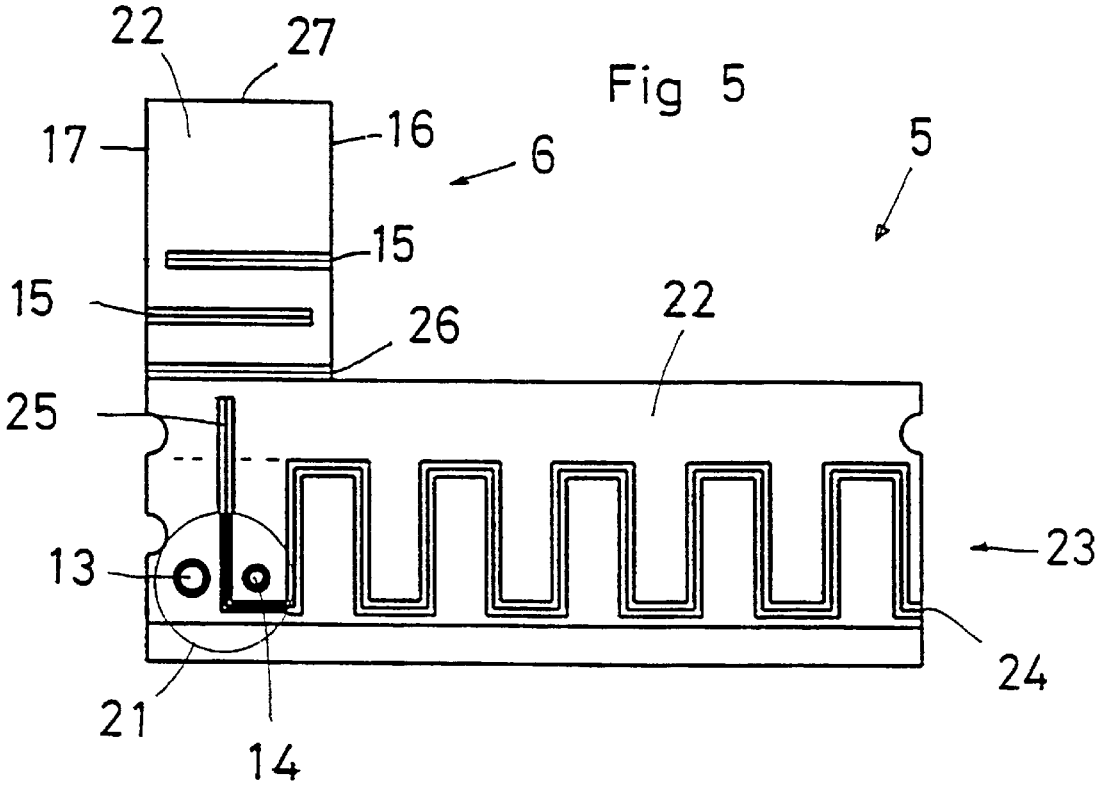
FIG. 5 is a circuit card for producing the antenna seen from the rear side according to FIG. 2.
Figure 6:
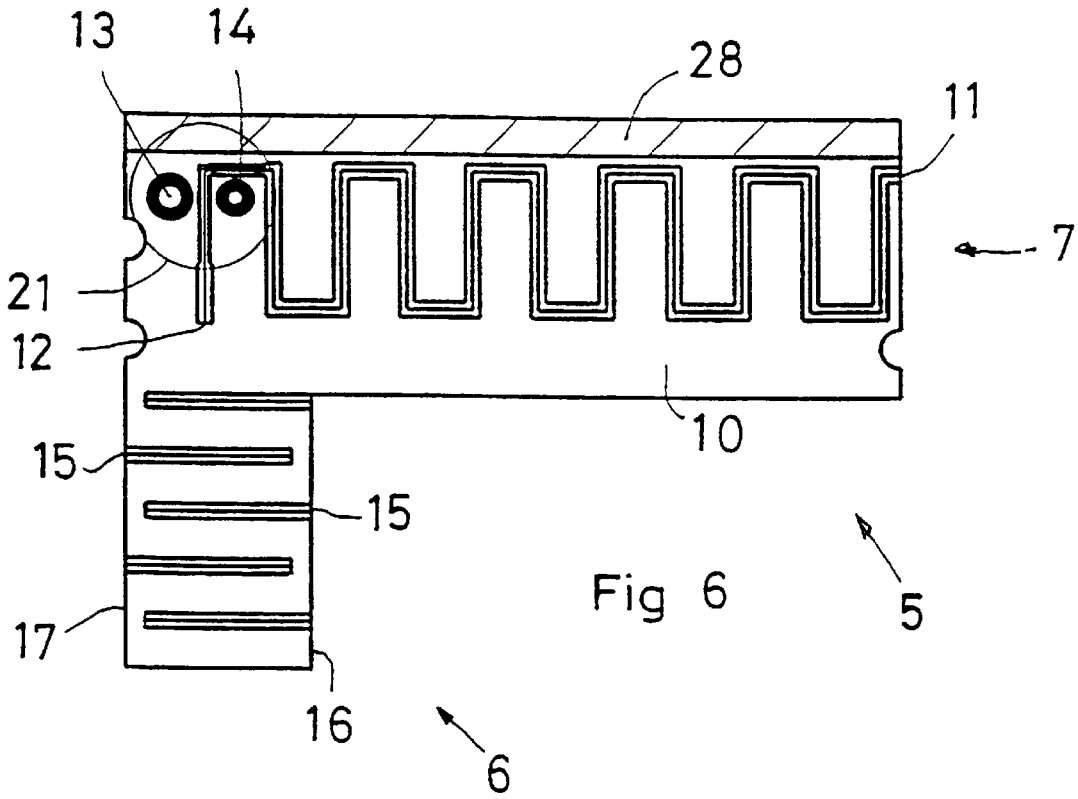
FIG. 6 shows the circuit card according to FIG. 5 seen from the front according to FIG. 2.

It will be apparent from FIGS. 5 and 6 that the carrier 20 also has on its rear side (the side facing away from the observer in FIG. 2) a foil-shaped, metallic conductor 22 with a slot 23. This slot also has an open end 24. The slots 7 and 23 follow one another throughout the greater part of their extent, but the slot 23 on the rear side of the antenna is, at its supply end, slightly longer than the slot 7 on the front side of the antenna. Thus, the slot 23 has an extension 25 in relation to that which applies to the slot 7.

That the slots 7 and 23 are of different lengths in this manner implies that they will be set for different resonance frequencies. As a result, there will be realised an antenna which, seen as a whole, is more wide band capable than the individual slots 7 and 23 would be separately.

It will further be apparent from FIG. 5 that the foil-shaped conductor 22 on the smaller rectangular part 6 is discrete, via a slot 26, from the major portion of the conductor which defines the slot 23. Further, there are, in the smaller rectangular part 6, counterparts to the slots 15 on the front side of the antenna. At the outer end edge 27 of the smaller rectangular part 6, both of the metallic conductors 22 and 10 are interconnected with one another via a plating or other thin metallic layer (not shown in the Figure).

The circuit card from which the antenna 4 is produced has, after provision of the slots, 15 and 23, been provided with a protective paint coating which can form the above-mentioned plastic filling of the slots.

As was mentioned above, at the terminal 21 there is only galvanic contact with the metallic conductor 22 on the rear side of the antenna while, on the other hand, no such galvanic contact exists with the metallic conductor 10 on the front side of the antenna.

Figure 4:
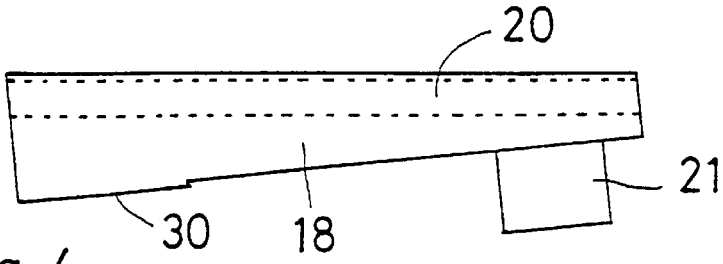
FIG. 4 is a view of the antenna of FIG. 2 seen from the right in FIG. 2.

It will be apparent from FIGS. 3 and 4 taken together that the plate 18 has a tongue 30 which only extends along a part of the length of the plate 18 but which is bent in on the underside of the carrier 20 and a distance from it. The tongue 30 constitutes an impedance adaptation between the antenna and its earth plane.

In one embodiment of the antenna 4 dimensioned for the 800 MHz band, the larger rectangular part 5 is dimensioned 31×11.2 mm. The smaller rectangular part 6 is dimensioned 11.2×7.4 mm.

The two slots 7 and 23 have a centre distance of approx. 3 mm between the long portions 9 of the slots, while the distances between the shorter portions 8 of the slots amount to approx. 3 mm.

The centre distances between the slots 15 is approx. 1.5 mm and their length amounts to approx. 6 mm.

The thickness of the carrier is approx. 1.6 mm while the width of the plate 18 in its narrower end (see FIG. 4) is 3.9 mm, while its cuneiform configuration amounts to 6.5°.

The length of the extension 25 is the slot 23 is such that the slot 23 is 1–3% longer than the slot 7.

DESCRIPTION OF ALTERNATIVE EMBODIMENTS

On the Drawings, the slots 7 and 23 are shown with meander formations in right angles and with "rectangular form". However, according to the present invention other embodiments of the meander formations are conceivable where, for example, the shorter portions 8 of the slots may be replaced by curved arcs. Furthermore, the meander formations may be "quadratic" or designed as serrations. On the other hand, it has proved that a pure sinusoidal form of the meander formations does not function well in practice.

The present invention may be further modified without departing from the scope of the appended claims.

What is claimed is:

1. An antenna for a radio communications apparatus operating in the frequency range of 800 MHz–3 GHz, the antenna comprising:

a first planar metallic conductor;

a first slot provided in the first metal conductor, said first slot having windings or meander formations disposed in the plane of said first conductor; and two connections designed for communication with a supply line, said connections being positioned on opposing sides of an end portion of said first slot.

2. The antenna as claimed in claim 1, wherein said antenna includes an earth plane disposed in said first metallic conductor.

3. The antenna as claimed in claim 1, wherein said antenna includes a second slot having windings or meander formations, and said first and second slots being disposed in parallel planes.

4. The antenna as claimed in claim 3, wherein said second slot is physically longer in length than said first slot.

5. The antenna as claimed in claim 4, wherein said second slot is physically 1–3% longer in length than said first slot.

6. The antenna as claimed in claim 3, wherein said first and second slots each have a total electric length of magnitude equating to one quarter of a wavelength.

7. The antenna as claimed in claim 3, wherein said first and second slots each have a total electric length of magnitude equating to one half of a wavelength.

8. The antenna as claimed in claim 3, wherein said first and second slots are open-ended at one of their repective ends and dead-ended at their respective opposite ends.

9. The antenna as claimed in claim 1, wherein said antenna includes a second metallic conductor in a second plane which is in a parallel relationship to said first planar metallic conductor.

10. The antenna as claimed in claim 9, wherein said first and second mettalic conductors are of metallic foil material.

11. The antenna as claimed in claim 9, wherein the second slot is formed in said second metallic conductor and said first and second slots are located each respectively in their metallic conductors, and said first and second metallic conductors are disposed on opposite sides of a panel of insulating material in a planar, parallel relationship to each other.

12. The antenna as claimed in claim 11, wherein said first and second mettalic conductors are in galvanic communication with each other.

13. The antenna as claimed in claim 12 wherein said first and second metallic conductors are galvanically connected by an elongated plate that is in contact with a side edge of said first and second metallic conductors.

14. An antenna for a radio communications apparatus operating in a frequency range of 800 MHz–3 GHz, the antenna comprising:

a first metallic conductor;

a first slot provided in the first metal conductor, said first slot having windings or meander formations disposed in one plane; and a plurality of connections designed for communication with a supply line, said connections being positioned on opposing sides of an end portion of said slot, wherein said antenna includes a second slot having windings or meander formations, and said first and second slots being disposed in parallel planes.

15. The antenna as claimed in claim 14, wherein said second slot is physically longer in length than said first slot.

16. The antenna as claimed in claim 14, wherein said antenna includes a second metallic conductor.

17. The antenna as claimed in claim 14, wherein said antenna includes an earth plane disposed in said first metallic conductor.

18. The antenna as claimed in claim 16, wherein the second slot is formed in said second metallic conductor and said first and second slots are located each respectively in their metallic conductors, and said first and second metallic conductors are disposed on opposite sides of a panel of insulating material in a planar, parallel relationship to each other.

19. The antenna as claimed in claim 18, wherein said first and second metallic conductors are in galvanic communication with each other.

20. An antenna for a radio communications apparatus operating in a frequency range of 800 MHz–3 GHz, the antenna comprising:

a first planar metallic conductor;

an insulating carrier supporting said metallic conductor, a meandering slot provided in the plane of said metallic conductor, and two connections designed for communication with a supply line, said connections extend into said carrier to opposite sides of said meandering slot and in a non-galvanic communication relationship with repect to said slot.

21. The antenna of claim 20 wherein said meandering slot includes a series of shorter and longer sections.

22. The antenna of claim 20 wherein said first metallic conductor is supported on a first carrier support surface and said antenna further comprising a second planar metallic conductor supported on a second carrier support surface and wherein said second metallic conductor includes a meandering slot.

23. An antenna for a radio communications apparatus operating in a frequency range of 800 MHz–3 GHz, the antenna comprising:

a first metallic conductor having a first portion and a second portion, said second portion extending laterally from said first portion, said first portion including a first slot, said second portion providing an earth plane for said first slot, and said first slot including windings or meander formations disposed in one plane, wherein a lateral part of said earth plane includes an electric length greater than its physical length, generated by disposing, alternatingly from opposing edges of said second portion, earth plane slots in said first metallic conductor.

24. An antenna for a radio communications apparatus operating in a frequency range of 800 MHz–3 GHz, the antenna comprising:

a first metallic conductor having a first portion and a second portion, said second portion extending laterally from said first portion, said first portion including a first slot, said second portion providing an earth plane for said first slot, and said first slot including windings or meander formations disposed in one plane, wherein said antenna includes a second metallic conductor including a second slot with windings or meander formations, wherein said first and second metallic conductors are foil-shaped and are in a parallel relationship.

25. An antenna for a radio communications apparatus operating in a frequency range of 800 MHz–3 GHz, the antenna comprising:

a first metallic conductor having a first planar portion and a second portion, said second portion extending laterally from said first portion, said first portion including a first slot, said second portion providing an earth plane for said first slot, and said first slot including windings or meander formations disposed in the plane of said first portion.

26. The antenna as claimed in claim 25, wherein said first planar portion has a greater length than said second portion.

27. The antenna as claimed in claim 25, wherein said first and said second portions are rectangular.

28. The antenna as claimed in claim 25, wherein a lateral part of said earth plane includes an electric length greater than its physical length, generated by disposing, alternatingly from opposing edges of said second portion, earth plane slots in said first metallic conductor.

29. The antenna as claimed in claim 31, wherein said first and second metallic conductors are in galvanic communication with one another via a plate which extends along a common pair of sides edges of said first and second metallic conductors and whose width is transversely directed in relation to a plane of extent of said first and second conductors.

30. The antenna as claimed in claim 29, wherein said plate includes a width greater than a distance between said first and second conductors, whereby said plate extends with at least one edge region out away from an adjacent metallic conductor.

31. The antenna as claimed in claim 25, wherein said antenna includes a second metallic conductor including a second slot with windings or meander formations.

32. The antenna as claimed in claim 31, wherein said first and second metallic conductors are each planar and in a parallel relationship.

33. The antenna as claimed in claim 31, wherein said first and second metallic conductors are in galvanic communication with one another.

34. The antenna as claimed in claim 33, wherein said metallic conductors include a first metal foil layer on a first face of an intermediate, insulting carrier and a second metal foil layer on an opposite face of said carrier, and said metal foils communicating across a plate member extending across a thickness of said carrier and one of said foils having a first section that is rendered discrete from a second section by a separations slot (26).

35. An antenna for a radio communications apparatus operating in a frequency range of 800 MHz–3 GHz, the antenna comprising:

a first metallic conductor;

a second metallic conductor;

a first slot provided in said first metallic conductor, said first slot having windings or meander formations disposed in a first plane;

a second slot provided in said second metallic conductor, said second slot having windings or meander formations disposed in a second plane; and said first and second planes being in a parallel relationship.

36. The antenna as claimed in claim 35, wherein said first and said second slots each have a total electric length of magnitude equating to one quarter of a wavelength.

37. The antenna as claimed in claim 35, wherein said first and second slots each have a total electric length of magnitude equating to one half of a wavelength.

38. The antenna as claimed in claim 35, wherein said first and second slots are open-ended at one of their respective ends and dead-ended at their respective opposite ends.

39. The antenna as claimed in claim 35, further comprising a plurality of connections designed for communication with a supply line, said connections being positioned on opposing sides of an end portion of said first slot.

40. The antenna as claimed in claim 39 further comprising an insulating carrier positioned between said first and second metallic conductors, and a terminal for connection with a suppply line, said terminal supporting said connections such that said connections extend through the carrier.

41. The antenna as claimed in claim 40 wherein said connections are arranged so as not to form a galvanic connectin with said first metallic conductor.

42. The antenna as claimed in claim 35, wherein said first and second slots follow one another in relation to a corresponding winding or meandering vertical cross-sectional plane.

43. The antenna as claimed in claim 42, wherein said second slot is of a greater length than said first slot.

44. The antenna as claimed in claim 43, wherein a difference in length between said first and second slots is 1–3%.

45. The antenna as claimed in claim 35, wherein said first and second metallic conductors are disposed on oppposite sides of a panel of insulating, non-magnetic material.

46. The antenna as claimed in claim 45, wherein said first and second metallic conductors are in galvanic communication with each other.

47. The antenna as claimed in claim 46 wherein said first and second metallic conductors are galvanically connected by an elongated plate that is in contact with a side edge of said first and second metallic conductors.

* * * * *